US006440007B1

(12) United States Patent
Imahata

(10) Patent No.: US 6,440,007 B1
(45) Date of Patent: Aug. 27, 2002

(54) GAME APPARATUS HAVING A SPHERICAL OBJECT DROP MECHANISM

(76) Inventor: Takeo Imahata, 7390 Woodsboro Ave., Anaheim, CA (US) 92807

( * ) Notice: Subject to any disclaimer, the term of this patent is extended or adjusted under 35 U.S.C. 154(b) by 0 days.

(21) Appl. No.: 09/538,116

(22) Filed: Mar. 29, 2000

(51) Int. Cl.[7] ..... A63B 57/00

(52) U.S. Cl. ..... 473/282; 211/15; 206/315.9; 221/251; 221/295; 224/919

(58) Field of Search ..... 473/134, 137, 473/132, 282, 286, 558, 559, 564, 316; 211/15; 206/315.9; 221/295, 312 R, 251, 175, 298, 299; 224/919

(56) References Cited

U.S. PATENT DOCUMENTS 5,147,101 A * 9/1992 Tiller
5,806,122 A * 9/1998 Bogle
5,996,839 A * 12/1999 McLinn

* cited by examiner

*Primary Examiner*—Stephen Blau
(74) *Attorney, Agent, or Firm*—Muramatsu & Associates

(57) ABSTRACT

A game apparatus has a mechanism allowing to drop spherical objects one by one on the desired positions on the ground. The spherical object drop mechanism includes a housing for storing a plurality of spherical objects to allow vertical movements of the spherical objects therein by their own weight, a first stopper provided in the housing for stopping the vertical movement of the spherical objects, a second stopper provided in the housing located at a location lower than the first stopper by the distance corresponding to the diameter of the spherical object for stopping the vertical movement or releasing the stop operation of the spherical objects, a stopper drive mechanism to operate the first stopper and the second stopper opposite to each other, and a knob to operate the stopper drive mechanism from outside.

12 Claims, 7 Drawing Sheets

GAME APPARATUS HAVING A SPHERICAL OBJECT DROP MECHANISM

FIELD OF THE INVENTION

This invention relates to a game apparatus having a mechanism to drop an object one by one. In particular, this invention relates to a game apparatus having a mechanism to store spherical objects such as golf balls and drop them onto the ground one by one by mechanical means.

BACKGROUND OF THE INVENTION

Men and women of all ages are enjoying the game of golf. Golf is a game to hit the ball having a diameter of about 4.3 cm (centimeter) on the ground with a lesser number of strokes to put the ball in a hole or cup on the green.

The game of golf can be roughly classified in its procedure into a process of placing the ball onto a green where a hole exits by using clubs like iron and wood, and a process of putting wherein the ball on a green is hit into the hole by using a putter.

When a player practices putting or plays putting as recreation, the player has to place a ball on the ground (placement). Hence, in order to practice putting ten (10) times, the player has to place the ball ten times. The routine of placing the ball is frustrating. Moreover, bending down to place a ball may pose significant difficulty for an elderly player or a player with a back pain. When a player practices putting with many balls, the player has to carry a container storing many balls such as a bag.

Thus, a means is desired to place a ball automatically without a player's action to bend over the ground to place a ball. A possible apparatus to achieve this objective can be classified into an apparatus mounting a spherical object drop mechanism to a club, and into an apparatus having a spherical object drop mechanism separately provided thereto.

If the apparatus to mount the spherical object drop mechanism independently from a golf club is to be used, the apparatus having the spherical object drop mechanism needs to be brought over with a player in addition to golf clubs. Moreover, when the spherical object drop mechanism is large, it must be fixed to a specific location on the ground and thus, the ball must be placed only on the same position.

For the apparatus to mount spherical object drop mechanism to a golf club is to be used, it is conceivable to place a ball on the ground with an electric powered mechanism. However, such a structure becomes complex, expensive and inconvenient since an electric power supply such as a battery must be used.

Thus, it is desirable to have a mechanism that allows ball placement on the desired position on the ground by mechanical means with simple structure and low cost.

SUMMARY OF THE INVENTION

Therefore, it is an object of the present invention to provide a game apparatus that allows to drop spherical objects one by one to be placed on desired positions on the ground.

It is another object of the present invention to provide a game apparatus having a container to store spherical objects therein and a mechanism that allows one spherical object to be dropped while preventing other spherical objects from being dropped.

It is a further object of the present invention is to provide a golf ball game apparatus which integrally includes a mechanism for dropping a golf ball one by one on the ground and a storage container of golf balls.

The game apparatus of the present invention has a mechanism allowing to drop a spherical object one by one on the desired positions or spots on the ground. The spherical object drop mechanism includes:

- a housing for storing a plurality of spherical objects to allow vertical movements of the spherical objects therein by their own weight;
- a first stopper provided in the housing for stopping the vertical movement of the spherical objects;
- a second stopper provided in the housing located at a lower location of the first stopper by the distance corresponding to the diameter of the spherical object for stopping the vertical movement or releasing the stop operation of the spherical objects;
- a stopper drive means to operate the first stopper and the second stopper for stopping and releasing in the opposite way with each other; and
- a knob to operate the stopper drive means from outside.

The game apparatus having the spherical object drop mechanism of the present invention enables to drop a ball one by one onto desired positions on the ground. Since the game apparatus of the present invention has a simple mechanical structure, it is strong and reliable requiring less maintenance, and can be produced economically with low cost.

DETAILED DESCRIPTION OF THE PREFERRED EMBODIMENTS

Figure 1:
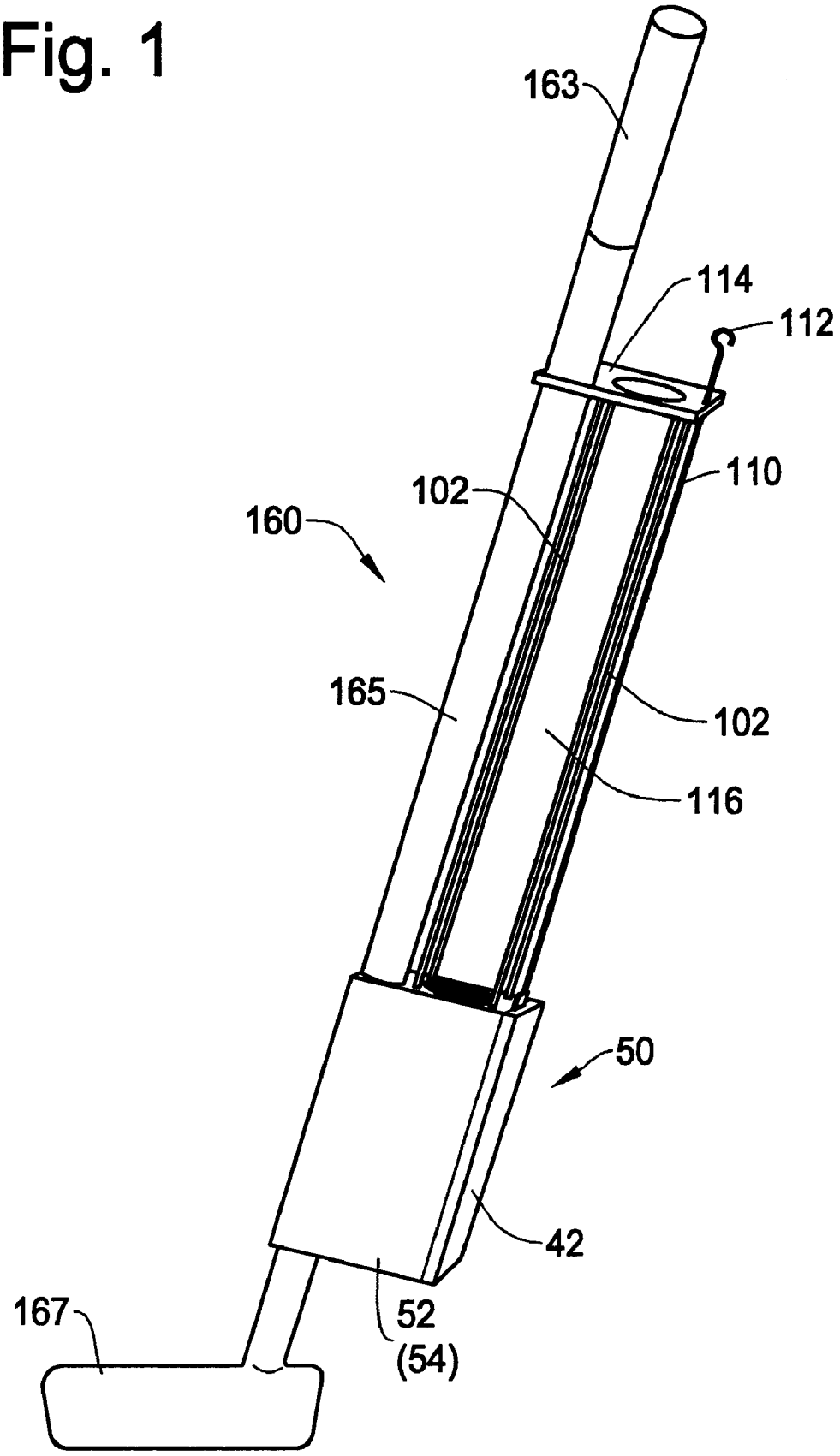
FIG. 1 is a perspective view showing an overall outside appearance of the game apparatus of the present invention wherein the spherical object drop mechanism is attached to a golf club.

The spherical object drop mechanism of the present invention attached to a golf club is explained with reference to FIG. 1. The spherical object drop mechanism 50 is fixed to a golf club 160 by, for example, screws (not shown). Namely, the spherical object drop mechanism 50 is connected to the golf club 160 in a manner to surround a club shaft 165 of the golf club at lower housings 52 and 54 and an upper support 114.

Between the upper support 114 and the housings 52 and 54, a ball guide 102 is provided to form an inner space. The inner space is to store spherical objects such as golf balls inserted from the insertion opening of the upper support. It is apparent that such an inner space for ball storage can be achieved by many other configurations, and the ball guide 102 in FIG. 1 is merely an example.

A handling bar 110 is provided in parallel to the guide rail 102. The upper end of the handling bar 110 has a knob 112 to pull the handling bar 110 upward. When a user (player) pulls the knob 112, the handling bar 110 also moves upward, and activates the stopper mechanisms in the spherical object drop mechanism 50. Thus, the structure of the drop mechanism 50 is so configured as to drop a ball one by one onto the ground by pulling the knob 112.

It is desirable to use lightweight and inexpensive material such as plastic for the spherical object drop mechanism 50 of the present invention so that the game apparatus as a whole may not become very heavy. By the game apparatus of the present invention, a user can grip the grip area 163 of the golf club to hit a ball on the ground by the club head 167 to enjoy the game or practice putting.

Figures 2A, 2B, 2C:
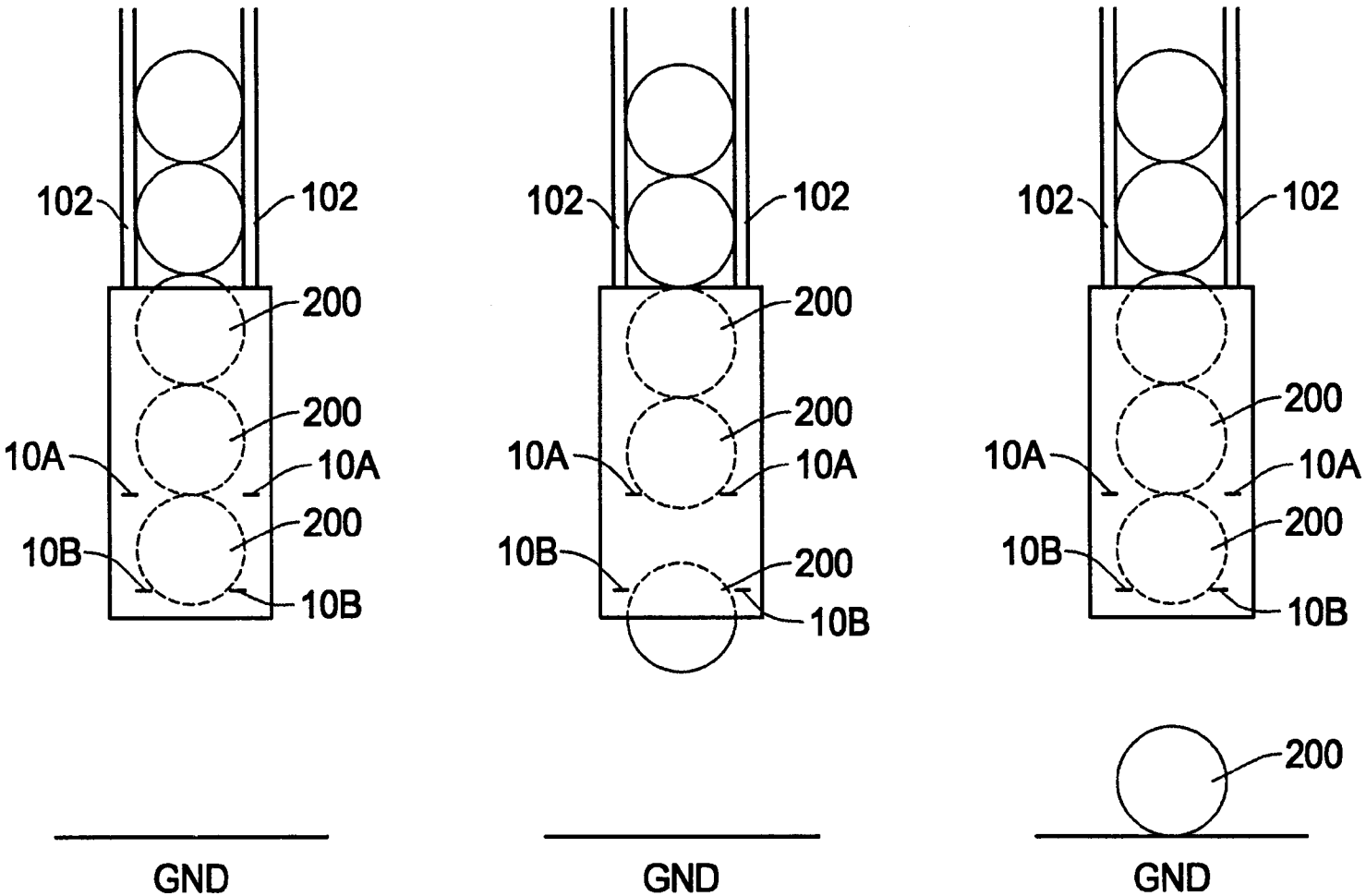
FIGS. 2A–2C are schematic cross sectional view showing the operation of the spherical object drop mechanism of the present invention.

FIGS. 2A–2C are schematic cross sectional views showing the operation of the spherical object drop mechanism 50 of the present invention. In the example of FIG. 2, an upper stopper 10A and a lower stopper 10B are provided in the spherical object drop mechanism 50. The relationship between these stoppers and balls 200 is shown in FIGS. 2A–2C. The stopper 10A and stopper 10B are made, for example, of straight wire. The configuration of the stopper is merely an example, and it is apparent that many other configurations can be utilized for the same purpose.

The distance between the upper stopper 10*a* and the lower stopper 10B is established as the size corresponding to the spherical object to be used such as a golf ball. Hence, the distance is established so that only one spherical object can exist between the upper stopper 10A and the lower stopper 10B. As will be explained later, the upper stopper 10A and the lower stopper 10B operate in the opposite ways with each other (stopper active and stopper release).

The FIG. 2A shows the operation of the spherical object drop mechanism 50 of the present invention in a default condition. In this condition, the upper stopper 10A is open (stopper release), and the lower stopper 10B is closed (stopper active). Thus, the lower stopper 10B prevents the ball from dropping onto the ground. The user can carry the game apparatus in this default condition to a desired location or wait for his or her turn to play.

The FIG. 2B shows the operation in the spherical object drop mechanism 50 wherein the user pulled the knob 112 (refer to FIG. 1) upward. By pulling the knob upward, the handling bar 110 moves upward as well, thereby driving a guide plate 32 (FIG. 3 and FIG. 4) to be explained later to activate the stoppers in the drop mechanism. Thus, the upper stopper 10A closes for stopper activation, and the lower stopper 10B opens for stopper release. Thus, only the lowermost ball 200 drops onto the ground while the other balls 200 that are positioned above the lowermost ball are prevented from moving by the upper stopper 10A. and are not dropped to the ground. Thus, only the lowermost ball is dropped to the desired spot on the ground (FIG. 2C).

FIG. 2C shows the condition of the spherical object drop mechanism 50 wherein the knob 112 is returned to the original position. By using, for example, springs, the inside of the drop mechanism 50 returns to the original position when the user releases the knob 112. As described in the foregoing, the lowermost ball 200 is already positioned by being dropped onto the ground. As the knob 12 returns to the original position, the stoppers in the drop mechanism also return to the original condition that is identical to the condition shown in FIG. 2A (default condition). Thus, in the situation of FIG. 2A, the upper stopper 10A is opened (stopper release), and the lower stopper 10B is closed (stopper activation). Thus the balls 200 lower their positions within the drop mechanism in the distance corresponding to the diameter of a ball. By repeating the operation described above, spherical objects can be dropped one by one onto the ground.

As shown above, the ball guide 102 forms a space to store balls and guides the ball to the stopper mechanism in the vertical direction. In this example, the ball guide 102 is configured with a plurality of rod shaped members. However, other shapes are also possible for the ball guide such as a cylindrical shape or a conical shape. By storing several balls in the ball guide 102, the balls can be conveniently carried along with a golf club. Thus, the balls can be positioned on the ground without requiring the user to bend his or her back.

By the stopper mechanism provided in the spherical object drop mechanism 50 of the present invention, the ball can be dropped one by one as shown in FIGS. 2A–2C as described above. The structure and operation of the spherical object drop mechanism 50 of the present invention is explained in more detail with reference to FIGS. 3–7.

Figure 3A:
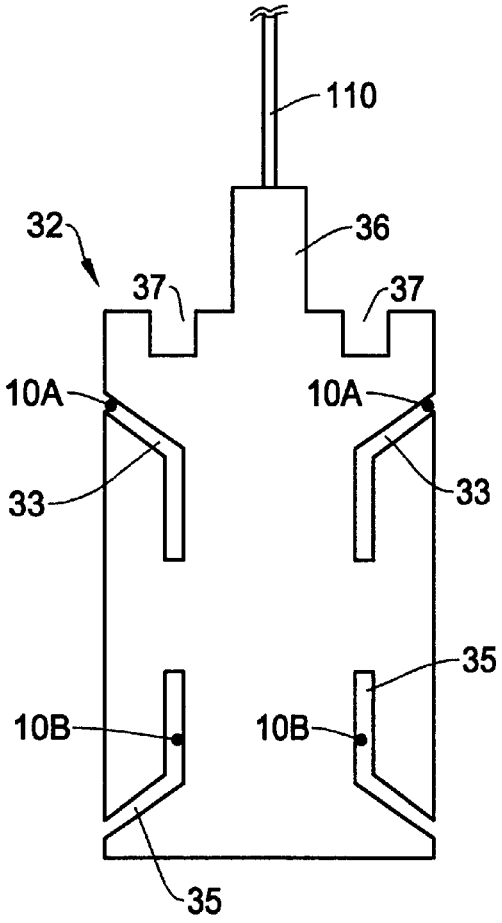
FIG. 3A and FIG. 3B are cross sectional views showing the inner structure of the spherical object drop mechanism of the present invention wherein the lowermost ball is caught (stopper is activated) by the mechanism.
Figure 3B:
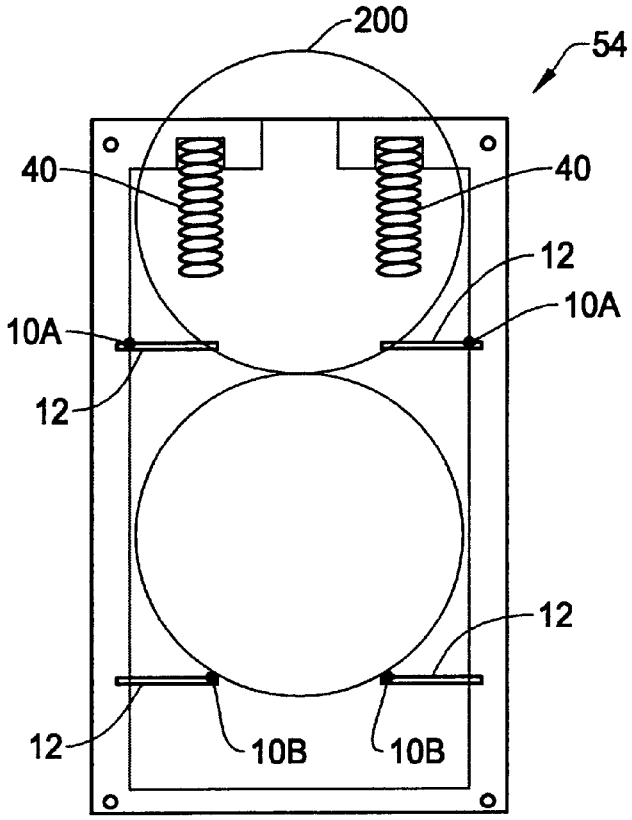

FIG. 3A and FIG. 3B show the structure of the stoppers in situation corresponding to that shown in FIG. 2A and FIG. 2C, i.e., the default condition. In this situation, the upper stopper 10A is opened (stopper release), and the lower stopper 10B is closed (stopper activated). As shown in the exploded view of FIG. 6, in the spherical object drop mechanism 50 of the present invention, the guide plate 32 is placed in the housing 54. FIG. 3A shows the guide plate 32 for setting the stoppers in the default condition, and FIG. 3B shows the housing 54.

Figure 4A:
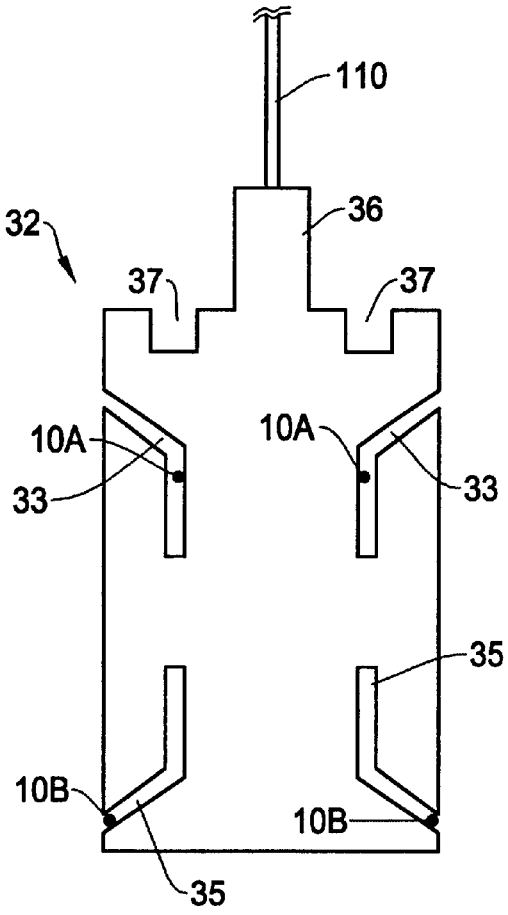
FIG. 4A and FIG. 4B are cross sectional views showing the inner structure of the spherical object drop mechanism of the present invention wherein the lowermost ball is dropped (stopper is released) from the mechanism.
Figure 4B:
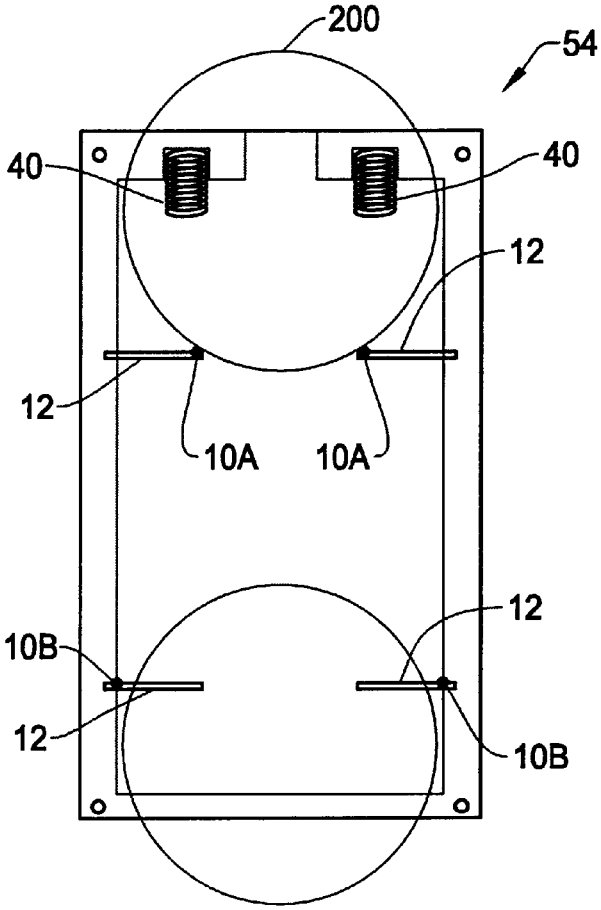

FIG. 4A and FIG. 4B show the condition of the stoppers wherein the knob 112 is pulled upward by the user as shown in FIG. 2B. In this condition, The upper stopper 10A is closed (stopper activation), and the lower stopper 10B is opened (stopper release). FIG. 4A shows the guide plate 32 setting the stoppers to drop the lowermost ball, and FIG. 4B shows the housing 54.

As described above, FIGS. 3A and 3B show the condition wherein the knob 112 is not pulled upward (thus in the default condition) as shown in FIGS. 2A and 2C. The lowermost ball 200 to be dropped is prevented from being dropped by the closed lower stopper 10B. Since the upper stopper 10A is released and is open, the balls above the lowermost balls are on the lowermost ball.

In FIG. 3A, the guide plate 32 is comprised of a stopper guide gap 33 to control the operation of the upper stopper 10A, a stopper guide gap 35 to control the operation of the lower stopper 10B, a spring storage gap 37 to install therein a spring 40 such as a spring coil, and a top portion 36 linking to the handling bar 110.

In FIG. 3B, the housing 54 is box-shaped to receive the guide plate 32 therein, and is provided with the spring 40 and stopper slits 12. In FIGS. 3A and 3B, the ball guide 102 and the knob 112 are omitted. As shown in FIGS. 3A and 3B, the ends of the upper stopper 10A and lower stopper 10B are inserted in the stopper guide gaps 33 and 35 of the guide plate 32, respectively. The other ends of the upper stopper 10A and the lower stopper 10B are fixed to the housing 52 shown in FIG. 6 or FIG. 7A through attachment holes (not shown).

Figure 6:
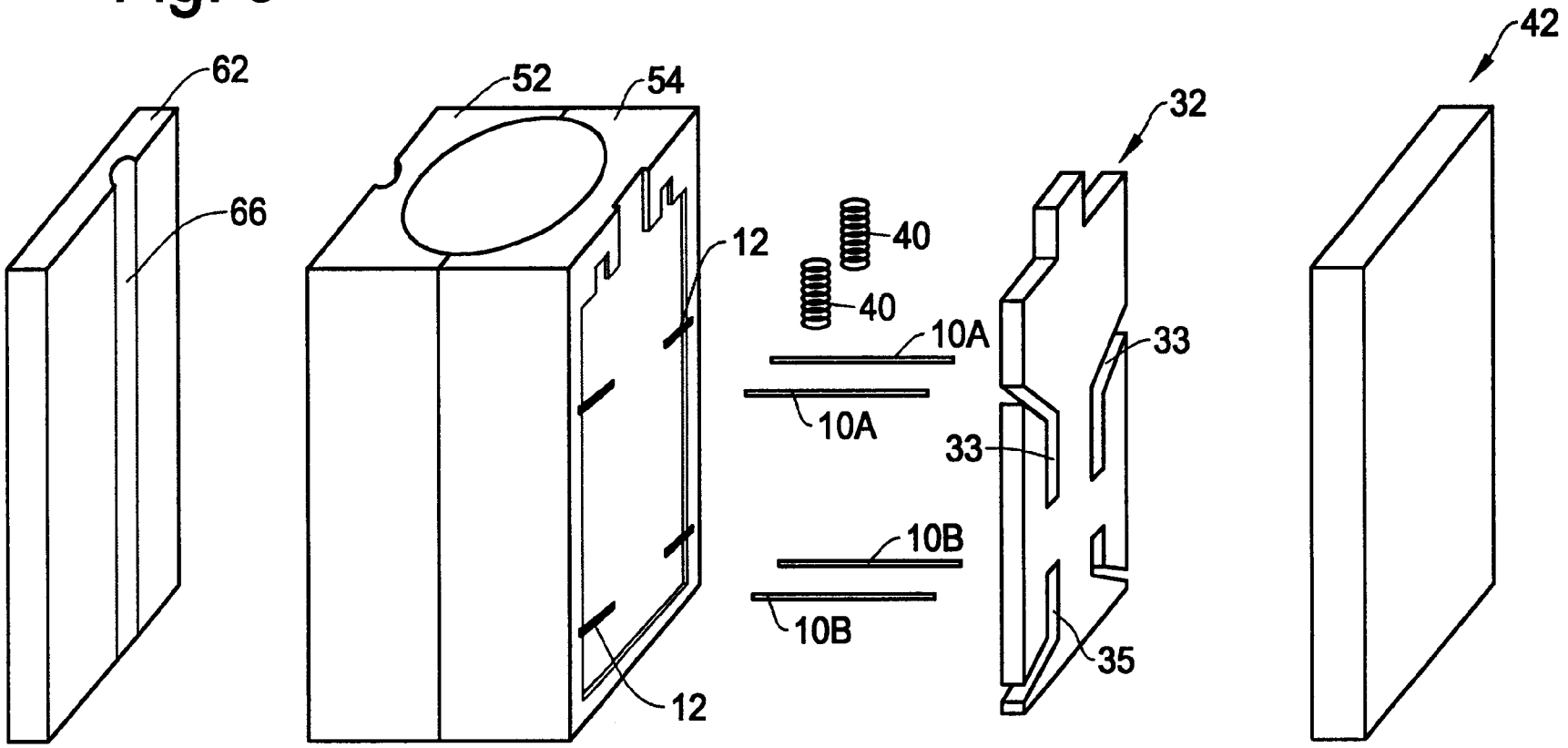
FIG. 6 is an exploded view of the spherical object drop mechanism of the present invention.
Figure 7A:
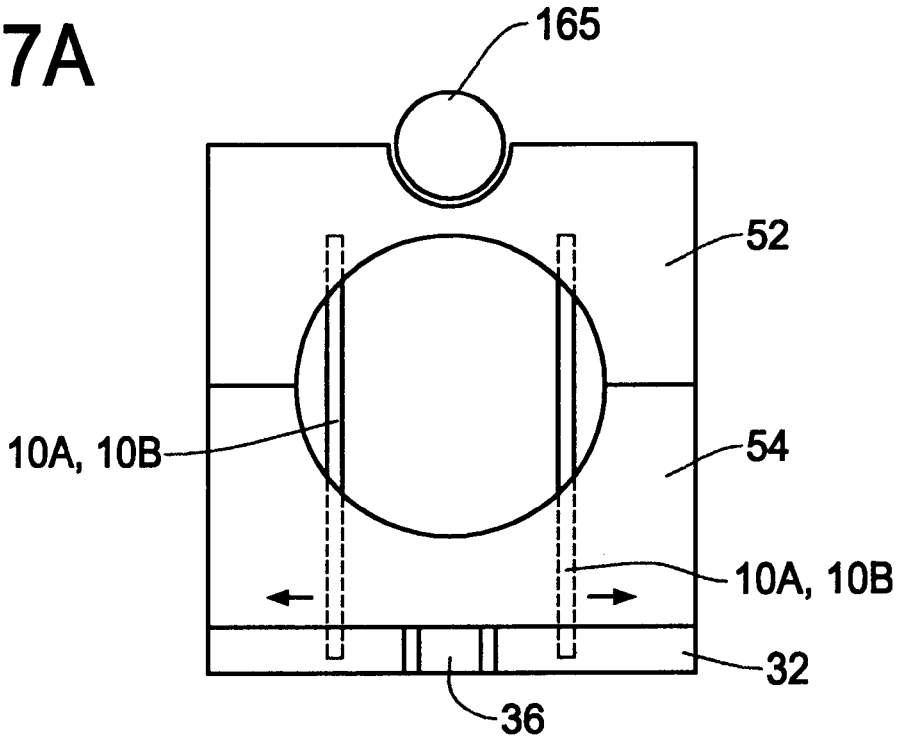
FIG. 7A is a cross sectional view showing a first example of stopper mounting structure of the spherical object drop mechanism of the present invention.
Figure 7B:
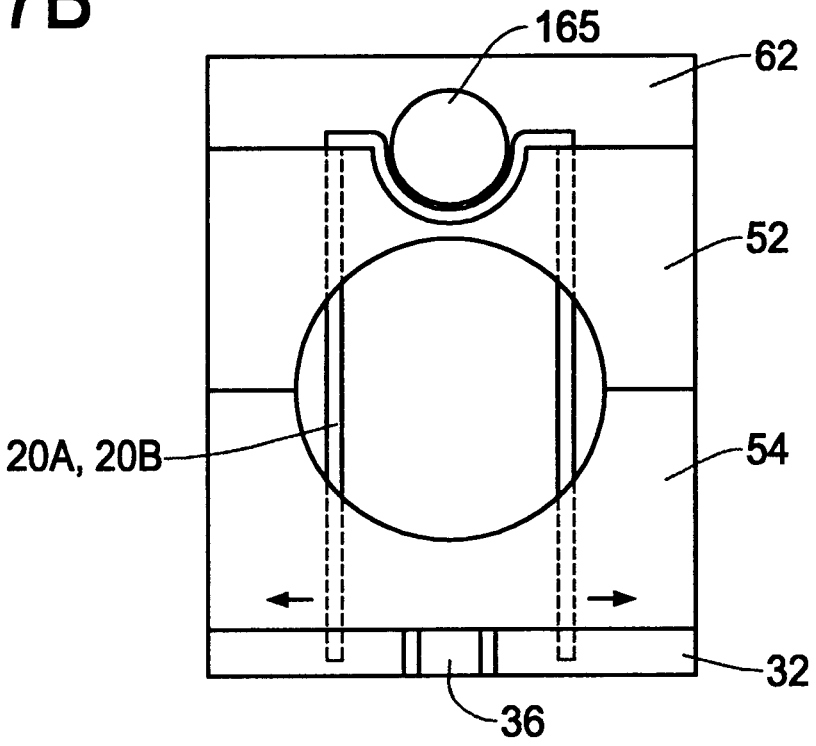
FIG. 7B is a cross sectional view showing a second example of stopper mounting structure of the spherical object drop mechanism of the present invention.

Before proceeding the explanation with regard to FIGS. 3 and 4, an overall structure of the spherical object drop mechanism 50 of the present invention is explained with reference to the exploded view of FIG. 6. As shown in FIG. 6, the spherical object drop mechanism 50 of the present invention is comprised of the housing 52 and 54, an attachment plate 62, the guide plate 32, and a cover 42. The attachment plate 62 covers the shaft 165 of the golf club with the housing 52 for attachment. In this example, the housing 52 and the housing 54 separately provided are attached with each other. However, they can also be integrally constructed as one unit. The cover 42 fixes the guide plate 32 in the housing 54.

The stopper slits 12 running in horizontal direction described in the foregoing are provided to the housing 54. As the guide plate 32 moves in the vertical direction, the upper stopper 10A and the lower stopper 10B move in horizontal direction through the stopper slits 12. The other ends of the upper stopper 10A and the lower stopper 10B, i.e., the left ends of the stoppers in FIG. 6, are fixed to the housing by suitable means. The upper stopper 10A and the lower stopper 10B are made of, for example, metal with elastic property. Hence, the inner ends of the upper stopper 10A and the lower stopper 10B are stationary due to the fixation to the housing while the other ends inserted in the guide plate 32 and the stopper slits 12 move in the horizontal direction through the stopper slits 12, thereby achieving the opening and closing movements of the stopper 10A and the stopper 10B.

As shown in FIG. 3 and FIG. 6, the upper stopper 10A and lower stopper 10B can move only in the horizontal direction while being prevented from the vertical direction movement since the stopper slits 12 extend in the horizontal direction. Thus, in the condition shown in FIGS. 3A and 3B, the upper stopper 10A is located at the slanted portion of the stopper guide gap 33 in the guide plate 32, and is located at the outer side of the stopper slit 12. As consequence, the upper stopper 10A is released. On the other hand, the lower stopper 10B is located at the vertical portion of the stopper guide gap 33 in the guide plate 32, and is located at the inner side of the stopper slit 12. Accordingly, the upper stopper 10A is closed. In other words, the vertical movement of the guide plate 32 is converted to the horizontal movement of the upper stopper 10A and the lower stopper 10B.

In FIGS. 3A and 3B, the upper stopper 10A and the lower stopper 10B fitted in the guide gaps of the guide plate 32 in FIG. 3A are in the same vertical positions as that of the upper stopper 10A and the lower stopper 10B fitted in the stopper slits 12 in FIG. 3B. As shown above, the upper stopper 10A is located at the slanted portion of the guide gap 33. Due to the horizontal movement through the slit 12, the upper stopper 10A opens. Conversely, the lower stopper 10B located at the vertical portion of the stopper guide gap 35 will close. Since the balls are prevented from free passage, they will not drop from the drop mechanism 53.

Figure 5A:
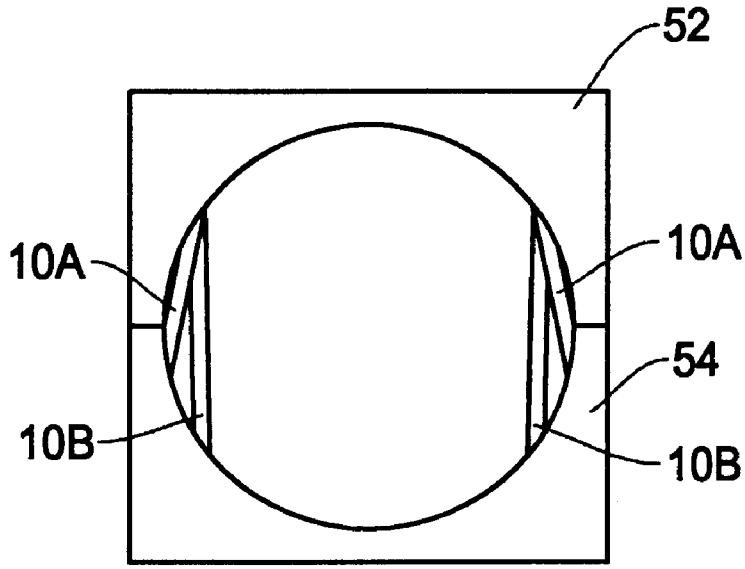
FIGS. 5A and 5B are schematic top views showing the spherical object drop mechanism of the present invention to be attached to the golf club.

FIG. 5A shows the stoppers in the condition of FIGS. 3A and 3B seen from the top of the housings 52 and 54. For the ease of explanation and simplicity, the ball 200 are not shown in Figure SA. As shown in FIG. 5A, the lower stopper 10B is closed, and the ball is prevented from being dropped onto the ground. The upper stopper 10A is opened that allows enough opening for the passage of the balls. Thus, the balls above the lowermost ball can freely go therethrough.

Referring to FIG. 4, the operation of the spherical object drop mechanism 53 when dropping the ball is described in more detail. FIGS. 4A and 4B show the condition of the stoppers wherein the upper stopper 10A is closed and the lower stopper 10B is opened to drop the lowermost ball when the knob 112 is pulled upward as shown in FIG. 2B. FIG. 4A shows the relationship between the stoppers and the guide plate 32, and FIG. 4B shows the relationship between the stoppers and the stopper slits 12.

As shown in FIG. 4A, the guide plate 32 is pulled upward in the housing 54. The upper stopper 10A and the lower stopper 10B are so positioned as to open the upper stopper 10A and the lower stopper 10B. Thus, the upper stopper 10A is positioned in the inner vertical portion of the stopper guide gap 33. This movement is converted to the horizontal movement by the stopper slits 12 shown in FIG. 4B, thereby closing the upper stopper 10A. Since the passage of the ball is prohibited, the balls above the lowermost ball will not drop from the drop mechanism.

The lower stopper 10B is located at the slanted outer portion of the stopper guide gap 35. When this movement is converted to horizontal movement by the stopper slit 12 shown in FIG. 4B, the lower stopper 10B opens. Thus, the lowermost ball 200 drops to the ground by the gravity. As described above, the upper stopper 10A is closed to prevent other balls from dropping, and only the lowermost ball is dropped to the ground.

Figure 5B:
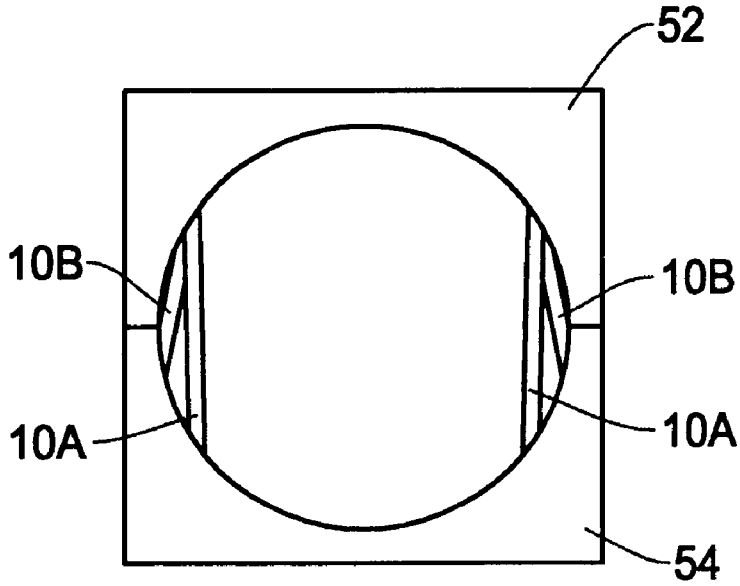

FIG. 5B is a top view showing the operation of dropping the ball as viewed from the top of the housings 52 and 54. For the ease of explanation and simplicity, the ball 200 is not shown in FIG. 5B. As shown in FIG. 5B, the upper stopper 10A is closed, thereby preventing the balls above the lowermost ball from dropping on the ground. The lower stopper 10B is opened to allow enough space for the passage of the lowermost ball. Thus, only the lowermost ball drops to the ground by the gravity.

After the lowermost ball is dropped, the guide plate 32 moves downward to return to the original position (default position). FIG. 2C shows this condition wherein one ball is positioned on the ground and the remaining balls go down one step within the drop mechanism 53. The upper stopper 10A is positioned in the slanted outer portion of the stopper 33. When this movement is converted to the horizontal movement, the upper stopper 10A opens. Hence the balls above the lowermost ball can freely go through. The lower stopper 10B is located to the inner vertical portion of the stopper guide gap 35. When converted to the horizontal movement, the lower stopper 10B closes. Thus, the balls 200 go one step down within the drop mechanism 50. This condition is identical to the one shown in FIG. 3. The top view of the housings 52 and 54 is identical to the one in FIG. 5A.

By repeating the operation described in the foregoing, the spherical object drop mechanism 50 can drop the balls one by one onto the ground. Since the game apparatus of the present invention has a simple mechanical structure, it is strong and reliable requiring less maintenance, and can be produced economically with low cost.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A game apparatus having a spherical object drop mechanism for dropping spherical objects one by one on the ground, the spherical object drop mechanism comprising:

a housing for storing a plurality of spherical objects to allow vertical movements of the spherical objects therein by their own weight;

a first stopper provided in the housing for stopping the vertical movement of the spherical objects or releasing the stop operation;

a second stopper provided in the housing located at a lower location of the first stopper by the distance corresponding to the diameter of the spherical object for stopping the vertical movement of the spherical objects or releasing the stop operation;

a stopper drive means to operate the first stopper and the second stopper for the stopping and releasing movements in opposite ways with each other; and a knob to operate the stopper drive means from outside;

wherein the stopper drive means is comprised of a guide plate connected to the knob and horizontal slits provided on the housing, and wherein the first stopper and the second stopper are fitted in guide gaps provided on the guide plate and the horizontal slits on the housing, and when the guide plate moves in the vertical direction by the movement of the knob, the first and second stoppers move in the horizontal directions in the horizontal slits.

2. A game apparatus as defined in claim 1, wherein, when the knob is in a steady state without being pulled upward, the first stopper is released so as to allow the vertical movement of the spherical objects, and at the same time, the second stopper is activated to prohibit the vertical movement of the spherical objects, thereby prohibiting the spherical objects as a whole from dropping on the ground.

3. A game apparatus as defined in claim 1, wherein, when the knob is pulled upward, the first stopper is activated to prohibit the vertical movement of the spherical object, and at the same time, the second stopper is released so that only a lowermost spherical object moves in the vertical direction to drop on the ground.

4. A game apparatus as defined in claim 1, wherein, the guide gaps provided on the guide plate have slanted portions, thereby creating the horizontal movements of the first and second stoppers when the guide plate moves in the vertical direction.

5. A game apparatus as defined in claim 1, wherein, the guide plate is biased downwardly by a spring force and is moved upward only when the knob is pulled upward, thereby activating the first stopper and releasing the second stopper.

6. A game apparatus for dropping spherical objects one by one on the ground, comprising:

a ball hitting rod having a shaft of substantially straight shape, a hitting face provided at one end of the shaft for hitting a spherical object and a grip provided at another end of the shaft for a user to handle the ball hitting rod;

a spherical object drop mechanism attached to the ball hitting rod in a parallel fashion for dropping the spherical objects one by one on the ground;

a spherical object container provided at an upper position of the spherical object drop mechanism for storing a plurality of spherical objects therein and providing the spherical objects to the drop mechanism; wherein the spherical object drop mechanism, comprising:

a housing for storing a plurality of spherical objects to allow vertical movements of the spherical objects therein by their own weight;

a first stopper provided in the housing for stopping the vertical movement of the spherical objects or releasing the stop operation;

a second stopper provided in the housing located at a lower location of the first stopper by the distance corresponding to the diameter of the spherical object for stopping the vertical movement of the spherical objects or releasing the stop operation;

a stopper drive means to operate the first stopper and the second stopper for the stopping and releasing movements in opposite ways with each other; and a knob to operate the stopper drive means from outside.

7. A game apparatus as defined in claim 6, wherein, when the knob is in a steady state without being pulled upward, the first stopper is released so as to allow the vertical movement of the spherical objects, and at the same time, the second stopper is activated to prohibit the vertical movement of the spherical objects, thereby prohibiting the spherical objects as a whole from dropping on the ground.

8. A game apparatus as defined in claim 6, wherein, when the knob is pulled upward, the first stopper is activated to prohibit the vertical movement of the spherical object, and at the same time, the second stopper is released so that only a lowermost spherical object moves in the vertical direction to drop on the ground.

9. A game apparatus as defined in claim 6, wherein, the stopper drive means is comprised of a guide plate connected to the knob and horizontal slits provided on the housing, and wherein the first stopper and the second stopper are fitted in guide gaps provided on the guide plate and the horizontal slits on the housing, and when guide plate moves in the vertical direction by the movement of the knob, the first and second stoppers move in the horizontal directions in the horizontal slits.

10. A game apparatus as defined in claim 9, wherein, the guide gaps provided on the guide plate have slanted portions, thereby creating the horizontal movements of the first and second stoppers when the guide plate moves in the vertical direction.

11. A game apparatus as defined in claim 9, wherein, the guide plate is biased downwardly by a spring force and is moved upward only when the knob is pulled upward, thereby activating the first stopper and releasing the second stopper.

12. A game apparatus as defined in claim 6, wherein the spherical object is a golf ball and the ball hitting rod is a golf club.

* * * * *